US006884083B2

(12) United States Patent
Shepherd

(10) Patent No.: US 6,884,083 B2
(45) Date of Patent: Apr. 26, 2005

(54) ELECTRICAL CONNECTOR

(75) Inventor: Martin J. Shepherd, Causeway Bay (HK)

(73) Assignee: Kettle Solutions Limited, Causeway Bay (HK)

( * ) Notice: Subject to any disclaimer, the term of this patent is extended or adjusted under 35 U.S.C. 154(b) by 0 days.

(21) Appl. No.: 10/167,629

(22) Filed: Jun. 12, 2002

(65) Prior Publication Data

US 2003/0232515 A1 Dec. 18, 2003

(51) Int. Cl.[7] ..... H01R 39/00
(52) U.S. Cl. ..... 439/18
(58) Field of Search ..... 439/18, 20, 21, 439/22, 23, 24, 675, 188, 60, 924.1

(56) References Cited

U.S. PATENT DOCUMENTS

| | | | | | |
|---|---|---|---|---|---|
| 3,398,260 | A | * | 8/1968 | Martens | 219/247 |
| 4,488,765 | A | * | 12/1984 | Erbe | 439/137 |
| 4,519,666 | A | | 5/1985 | Williams et al. | 439/578 |
| 4,528,429 | A | * | 7/1985 | Dobson et al. | 200/50.28 |
| 4,707,042 | A | * | 11/1987 | Haden | 439/140 |
| 4,772,215 | A | * | 9/1988 | Falk | 439/188 |
| 4,812,623 | A | * | 3/1989 | Haden et al. | 219/437 |
| 5,971,810 | A | * | 10/1999 | Taylor | 439/675 |
| 6,241,559 | B1 | * | 6/2001 | Taylor | 439/675 |
| 6,428,339 | B1 | * | 8/2002 | Davidson et al. | 439/346 |
| 6,464,540 | B1 | * | 10/2002 | Sato | 439/668 |

FOREIGN PATENT DOCUMENTS

| | | | | |
|---|---|---|---|---|
| EP | 0 839 486 A1 | * | 5/1998 | A47J/27/21 |
| GB | 2 285 716 | A | 3/1994 | H01R/13/453 |
| GB | 2 318 926 | A | 9/1994 | H01R/13/44 |
| GB | 2 297 438 | A | 3/1995 | H01R/33/20 |
| GB | 2 303 977 | A | 10/1996 | A47J/27/21 |
| GB | 2 307 362 | A | 1/1997 | A47J/27/21 |
| GB | 2 328 143 | A | 8/1997 | A47J/27/21 |
| GB | 2 361 815 | A | 4/2000 | H01R/13/502 |
| GB | 2 362 313 | A | 4/2001 | H05B/3/00 |
| TW | 32591 | | 9/1980 | |
| WO | WO95/34187 | | 12/1995 | H05B/1/02 |
| WO | WO95/343188 | | 12/1995 | H05B/1/02 |
| WO | WO98/30066 | | 7/1998 | H05B/1/02 |

* cited by examiner

*Primary Examiner*—Phuong Dinh
(74) *Attorney, Agent, or Firm*—Baker Botts L.L.P.

(57) ABSTRACT

An electrical connector for providing an electrical connection between the body of a cordless electrical appliance and a base which in use is connected to an electrical supply has a male connector part (10), and a female connector part (12), the female connector part (12) comprising recesses (28, 26, 24) into which electrical contacts (30, 42, 52) extend, and the male connector part comprising electrical contacts (60, 62, 64) for engaging the contacts within the recesses of the female connector, allowing engagement of the male and female connector parts over 3600 of relative rotational orientation, wherein the female connector part (12) is provided with an isolating switch or switches connected to the electrical contacts having movable switch actuators (40, 50) extending into an annular recess (22) on the connector and disposed spaced from each other, and wherein the male connector part is provided with an annular surface arranged to protrude into said recess to engage the actuators and close said switches sequentially on mating of the male and female connector parts.

32 Claims, 5 Drawing Sheets

SECTION: A-A

SECTION: B-B

SECTION: C-C

SECTION:X-X

ELECTRICAL CONNECTOR

BACKGROUND OF THE INVENTION

The present invention relates to an electrical connector for use in cordless domestic appliances, in particular but not exclusively appliances such as kettles or irons or similar.

It is well-known to provide so-called "cordless" electrically powered appliances of the type which are either hand-held or picked up by a user. A separate base part is provided which is plugged into a wall socket, the appliance being positioned on the base to receive power. An electrical connector of a plug and socket type is provided of which one part is connected or formed in the base and the other connected to or formed in the lower part of the body of the appliance. Generally, terminal pins in the plug part engage contacts provided within recesses or openings in the socket part.

It is also known to provide an electrical connector for a cordless appliance in which the plug and socket are of a construction which allows the appliance to be seated on the base in any relative rotational orientation through a vertical axis. Such 360° type connectors are disclosed in GB 2285716A and GB 2297438A where they are used in cordless kettles.

Primary requirements in the design of such 360° type connectors are safety, ease of use and durability. The present invention seeks to provide an improved 360° type connectors for use particularly in kettles, but also finding applicability in other cordless domestic electrical appliances.

SUMMARY OF THE INVENTION

According to a first aspect of the invention there is provided an electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector part, said recesses and contacts being adapted to allow engagement of the connector parts over 360° of relative rotational orientation, wherein one connector part for the base is provided with an isolating switch or switches connected to the electrical contacts having a movable switch actuator or actuators engageable by engagement means on the other connector part, wherein the actuators and said engagement means are disposed relative to the electrical contacts on said connector parts such that physical contact is made between said electrical contacts before closing of the switch or switches on mating of the connector parts.

Preferable, a pair of isolating switches are provided connected to respective contacts which in use are live and neutral contacts, said isolating switches being adapted to close and open sequentially one before the other on mating and disengagement of the connector parts.

The provision of the isolating, switch or switches operated by actuators as described provides a structure which is particularly safe, as when the appliance is not fitted on the base the contacts in the connector are separately electrically isolated. Moreover, accidental activation is extremely difficult.

The sequential electrical activation of live and neutral contacts provides important safety benefits. The electrical components in a kettle provide both resistance and inductance (in particular resistive coil heating elements) as well as a degree of capacitance in the control elements. It is found that if both live and neutral connections are broken simultaneously arcing or sparking can occur, with sparks jumping to earth. This problem is made worse if the kettle is disconnected very rapidly. The sequential breaking (and making) of the electrical circuit overcomes or at least mitigates this problem.

In the preferred embodiment the female connector part comprises a first outer annular recess and a second annular recess arranged within the first recess and concentric therewith, and a central third recess within the second recess, electrical contacts extending into each recess, the male connector part comprising a first outer annular contact, a second annular contact within the first annular contact and a third central contact within the second annular contact for engagement within the first, second and third recesses of the female connector part respectively. The two electrical contacts connected to the isolating switches are formed unitarily with or connected to springy strips disposed facing each other and spaced from fixed contact strips, and wherein said switch actuators are formed of non-conducting material disposed to engage the springy strips whereby displacement of the actuators urges the spring strips into contact with the fixed contact strips. The distance between the fixed contact strip and the opposed springy strip is smaller in the case of one of the switches as compared to the other. The switch means are connected to the electrical contacts extending into the central recess, and into the second annular recess, these being the live and neutral contacts. Preferably, the one connector part for the base is provided with an annular recess within which the switch actuator or actuators extend, and wherein the other connector part is provided with an annular surface arranged to protrude into said annular recess and close said switches on mating of the male and female connector parts. Preferably, the actuators are disposed diametrically opposite to each other within their recess.

The annular recess has at least one opening therein for drawing any fluid which is spilled in the recesses. Moreover, the actuator or actuators may have upstanding skirt portions at their lower end or ends with an upstanding skirt portion for trapping any water which might seep down the side of the actuator. The annular surface of surface of the male connector part has a leading edge which is spaced in the axial direction from leading edges of the first and second electrical annular contacts and the third central contact. More particularly, the electrical contacts in the recesses or openings of the female connector part are spring contacts against which the contacts of the male connector part engage on mating of the male and female connector parts.

Establishing the physical connection between the electrical contacts prior to electrical activation of the switch reduces the risk of arcing which can otherwise occur if electrical connection is being made on the initial physical contact. Likewise, breaking the electrical circuit before physical disconnection reduces the risk of arcing on separation of the connector parts.

In a further aspect the invention resides in an electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector part, said recesses and contacts being adapted to allow engagement of the connector parts over 360° of relative rotational orientation, wherein one connector part being for the base is provided with isolating switches connected respectively to live and neutral electrical contacts having movable switch actuators engageable by engagement means on the other connector part, said isolating switches being adapted to close sequentially one before the other on mating of the connector parts.

In a further aspect the invention resides in an electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector, said recesses and contacts being adapted to allow engagement of the male and female connector parts over 360° of relative rotational orientation, wherein one female connector part for the base is provided with an isolating switch or switches connected to the electrical contacts having movable switch actuators extending into an annular recess on that connector part, and wherein other connector part is provided with an annular surface arranged to protrude into said annular recess to engage the actuators and close said switches on mating of the male and female connector.

The invention also resides in a cordless kettle with base having a connector as defined above.

In a still further aspect the invention resides in a cordless electrical kettle having a main body with a water-carrying vessel and a base which in use is connected to an electrical supply and a connector to provide electrical connection there between in any relative rotational orientation, wherein the ratio of the diameter of the connector part on the base to the diameter of the main body where it sits on the base is at least 0.18. The ratio may be at least 0.22.

More particularly, where the diameter of the main body is preferably about 200 mm the said ratio, is about 0.18, where the diameter is about 160 mm the said ratio is preferably about 0.22.

In a still further aspect the invention provides an electrical connector for use in providing electrical connection between the body of a cordless appliance and a base which in use is connected to an electrical supply, the connector comprising male and female connector parts, the female connector part including a plurality of concentric annular or circular recesses into which electrical contacts extend, and the male part including corresponding annular or circular contacts which are engageable in the recesses whereby electrical connection can be effected in any relative rotational orientation, wherein the female connector part has a diameter which is at least 3.0 times the axial distance of relative movement which occurs as the connector parts are moved between complete engagement and disengagement. A connector of such dimension is particularly easy to engage on the base, allowing use even by infirm or incapacitated persons who otherwise are unable to use kettles with conventional 360° is type connectors.

In a still further aspect the invention resides in a cordless electrical kettle having a main body with a water-carrying vessel, a heating element and heat sensitive switch, and a base which in use is connected to an electrical supply, with an electrical connector having a male connector part on one of the main body and base and female connector part on the other of the main body and base to provide electrical connection there between in any relative rotational orientation about a vertical axis, wherein the connector part on the main body is supported on a part of an electrical heating element housing, wherein electrical wires which connect the connector part on the main body to the heating element and/or heat sensitive switch are permanently secured to the said connector part on the main body, and wherein a cover part for enclosing a lower region of the water carrying vessel, the heating element and heat sensitive switch is supported on the said connector part. In a still further aspect the invention resides in a method of assembling a cordless electrical kettle having a main body with a water-carrying vessel, a heating element and heat-sensitive switch, and base with electrical connection between the base and kettle main is body through an electrical connector having a male connector provided on one of the main body or base and a female connector provided on the other of the main body or base, the method involving the steps of: (a) permanently securing electrical wires to the connector part for the kettle main body; (b) securing a heating element and heat sensitive switch onto a lower region of the water-carrying vessel; (c) securing said wires to the heating element and/or to the heat sensitive switch; (d) securing the said connector part to a housing part of the heating element; and (e) securing a cover part to enclose a lower region of the water-carrying vessel, heating element and heat sensitive switch onto said connector.

In a still further aspect the invention provides an electrical connector for providing an electrical connection between the body of a cordless electrical appliance and a base which in use is connected to an electrical supply, the connector comprising a male connector part for connection to the appliance, and a female connector part for connection to the base, the female connector part having a body defining upwardly facing recesses or openings provided with electrical contacts extending therein, and the male connector part comprising electrical contacts for engaging the contacts within the recesses or openings of the female connector part, said recesses and contacts being adapted to allow engagement of the connector parts over 360° of relative rotational orientation, wherein the female connector part is provided with an isolating switch or switches beneath the recesses or openings connected to the electrical contacts having a movable switch actuator or actuators engageable by engagement means on the male connector part, the or each switch comprising a contact pair including a movable contact piece connected to the electrical supply and a fixed contact piece connected to the contacts extending within the recesses or openings, wherein the movable contact piece is disposed in a chamber defined in the connector body which has no upward communication with the recesses or openings and is arranged above the fixed contact piece.

This arrangement ensures that the live electrically conductive live parts in the base remain dry even if a substantial amount of water is spilled on the connector.

In a preferred structure the body of the female connector has walls which define at their lowermost edges a lowermost body surface, said movable contact being spaced from said lowermost body surface. The movable contact piece is fixed to a springy strip spaced from said lowermost body surface against which a lower end of the actuator engages. The chamber is open-bottomed so as not to trap any water entering this.

BRIEF DESCRIPTION OF THE DRAWINGS

An embodiment of the invention is now described, by way of example only, with reference to the following drawings in which.

DESCRIPTION OF THE PREFERRED EMBODIMENT

Figure 1:
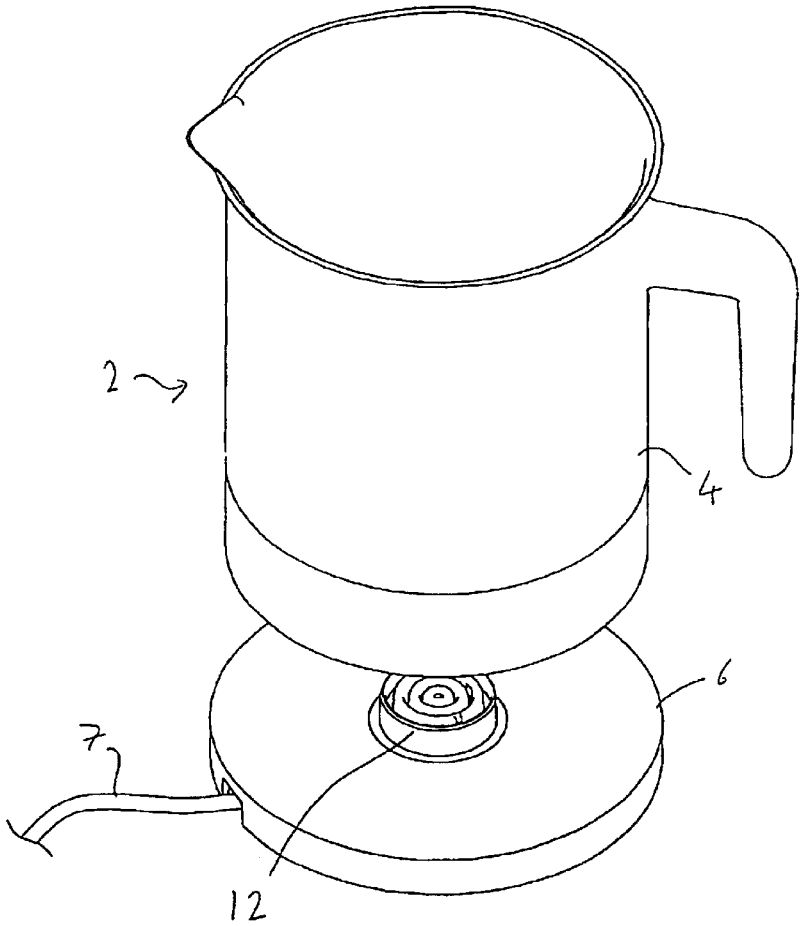
FIG. 1 shows a kettle with a powered base incorporating a connector in accordance with an embodiment of the invention, with the female connector part visible.
Figure 2:
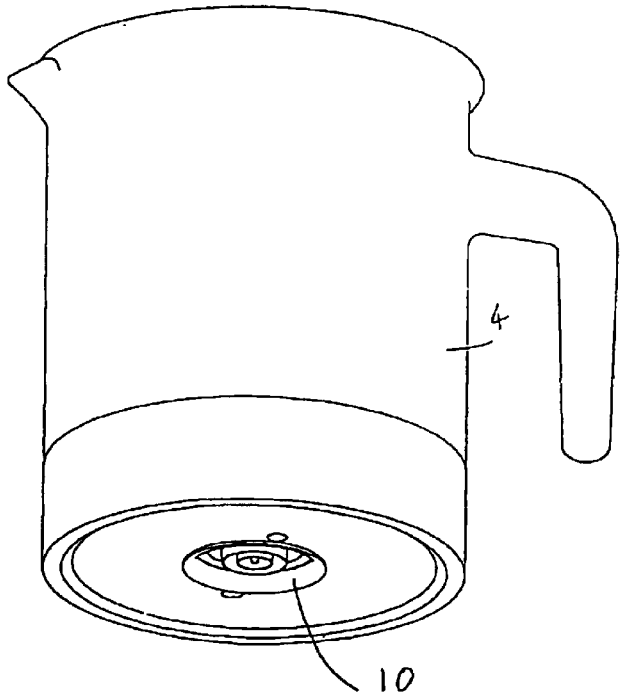
FIG. 2 shows a body of a kettle in which a male connector part of the kettle is visible.
Figure 12:
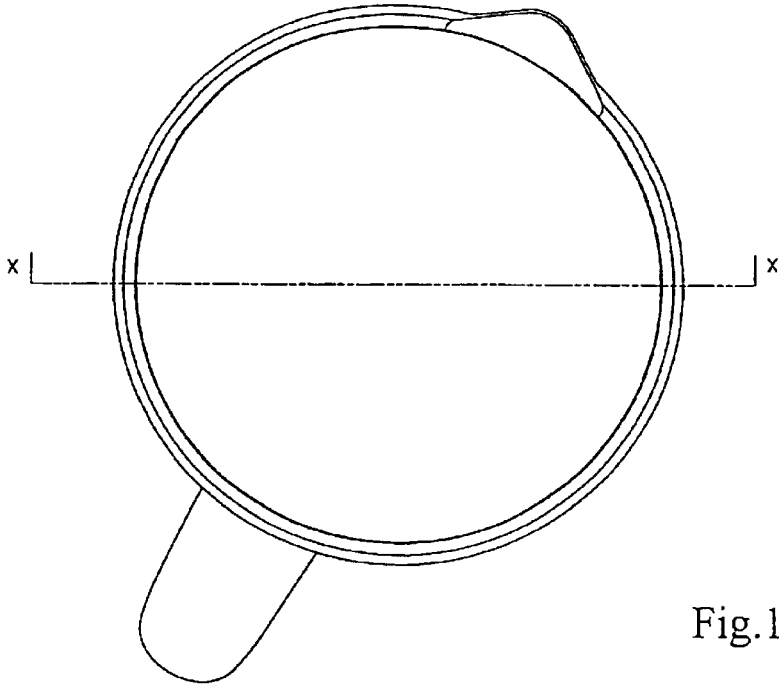
FIG. 12 is a view of the kettle from above.

Turning to the drawings, and more particularly FIGS. 1 and 2, these show a kettle body indicated generally by numeral 2 having a hollow water-holding receptacle 4, and a separate power-supplying base 6. The kettle will have a lid, but this is not shown for reasons of clarity. In use, the power-supplying base 6 is provided with a power cord 7 allowing its connection to a mains electrical supply. The kettle includes an electrical heating element which may take a variety of forms such as a hidden or under floor-type heating element 80 such as of the printed thick-film type or mineral-filled resistive wire-type as is shown in FIG. 12. An electrical connector is provided having male and female connector parts 10, 12 respectively which are fitted to or in the base 6 and kettle body 4 respectively. Power is supplied from the base 6 to the kettle body 4 through the connector. The kettle 2 includes other components such as a control unit with a thermal sensor to detect steam to switch the kettle off on boiling, and other associated components such as a dry boil cut-out, as is conventional.

Figure 3:
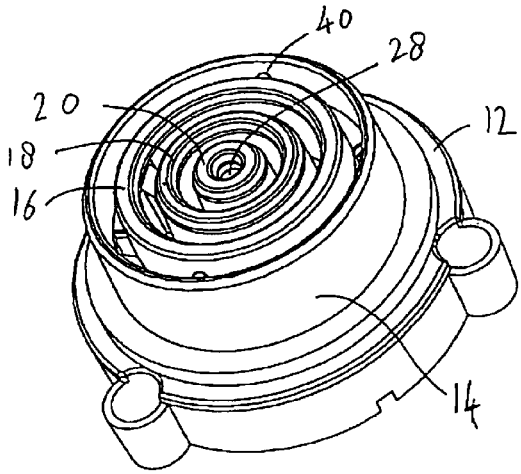
FIG. 3 shows the female connector part detached from the base.

FIG. 3 shows the female connector part 12 removed from the base 6. As can be seen in FIGS. 3 to 7 the female connector part 12 comprises a moulded body having an upstanding outer circular wall portion 14 which when fitted upstands from the base 6, and mouldings which define three concentric annular walls 16, 18 and 20. The walls 14, 16, 18 and 20 define there between annular recesses 22, 24 and 26 and a central circular opening 28.

Each recess 22, 24 and 26 has a blind lower end. At particular locations electrical contacts 30, 42 and 52 extend into the central opening 28, and recess 26 and 24 respectively through openings these being neutral (N) live (L) and earth (E) contacts respectively. Isolating electrical switches are connected to both live and neutral contacts as explained further below.

Figure 6:
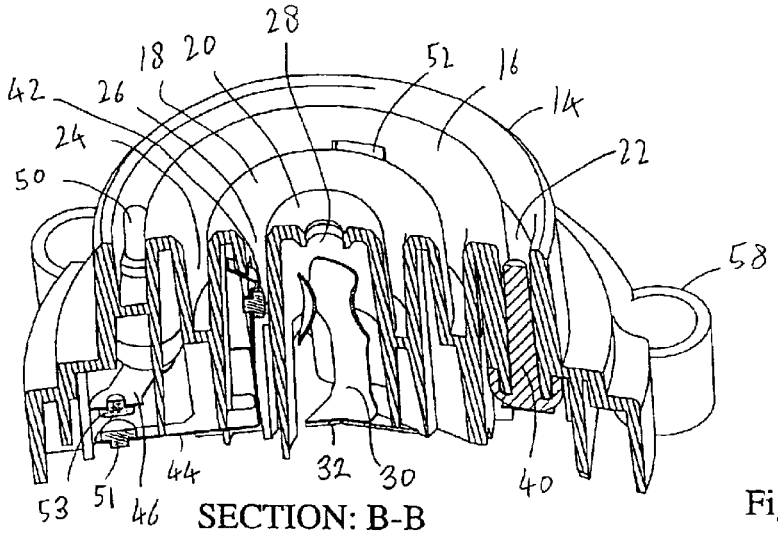
FIG. 6 is a sectional view along the line B—B in FIG. 4 (inverted relative to FIG. 4)
Figure 7:
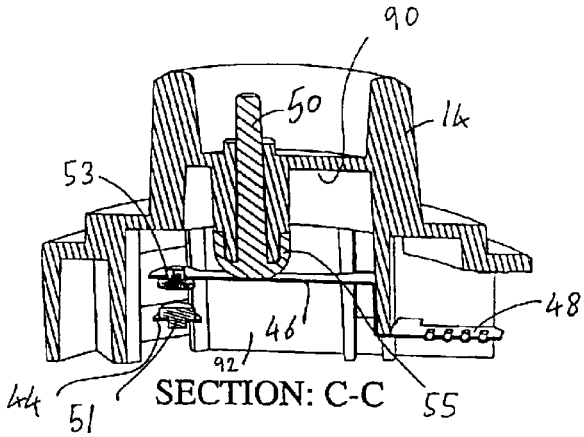
FIG. 7 is a sectional view along the line C—C in FIG. 4.
Figure 8:
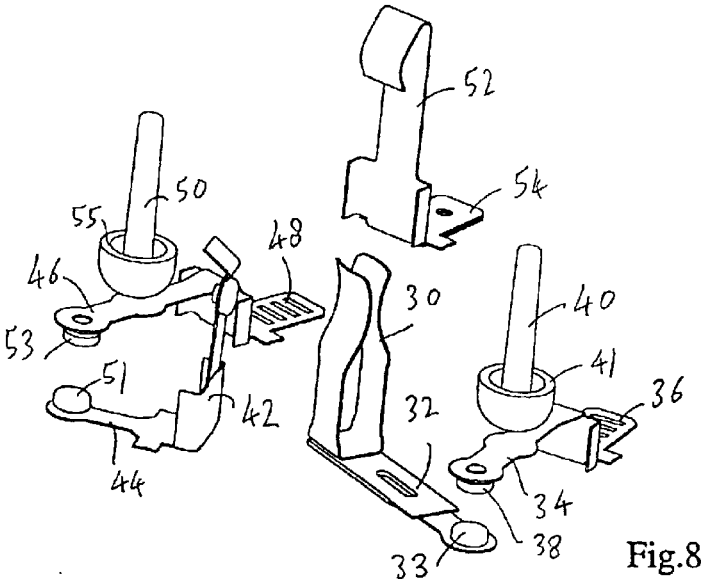
FIG. 8 is an exploded view of the conducting parts of the female connector part.

More particularly, in central opening 28 there is provided upstanding contact 30 in the form of a U-shaped member defining a pair of opposed springy fingers secured at the base to one end of an elongate plate 32. (Although the central opening is shown as being circular, an annular opening could instead be provided, with suitable adaptation to the central contact of the male part). The plate 32 forms part of a first switch as now explained. The opposite end of the plate 32 forms part of a fixed contact and is formed with a contact piece 33 which may be formed of silver or copper. A movable springy strip 34 best seen in FIG. 8 is supported at one end 36 through a dog leg where a spade terminal is formed, for attachment of electrical wires (not shown). At the opposite end strip 34 has a contact piece 38 of silver or copper which overlies contact piece 33, being spaced a small distance from contact piece 33 (when the male and female connector parts 10, 12 are separated). An actuator pole 40 formed of insulating material overlies the strip 34 near the mid point thereof, and extends upwardly through a cylindrical passage in the body of the female connector part extending through an opening in the lower end of the recess 22. A lower end of the actuator pole rests on or co-operates with the strip such that depression of the actuator pole 40 closes the first switch. As can be seen in FIGS. 6, 7 and 8 the lower end of the actuator pole 40 is formed with an upstanding skirt portion 41 somewhat in the manner of an upturned mushroom. The purpose of this skirt 41 is to retain any spilled water which becomes drawn (for example through capillary action) through the small clearance between actuator pole 40 and the opening in the body. The small clearance between the skirt 41 and body of the pole actuator 40 effectively retains through capillary action any such water, keeping it away from the electrically live parts of the switch.

The live electrical contact 42 is generally L-shaped (see FIG. 4) and extends up into recess 26 comprising a springy metal strip having a bent over upper end to form a spring contact, and extends at its lower end horizontally defining a plate 44. A second switch is constituted by a springy strip 46 (best seen in FIGS. 6 and 7) having a dog leg and an end portion defining a spade terminal 48 for attachment of electrical wires, and an insulating actuator pole 50 identical to pole 40 which extends into the recess 22 at a position in the recess 22 diametrically opposed to actuator 40. The pole 50 is likewise formed with a water-retaining skirt portion 55. An upper end of the actuator 50 is just visible in FIGS. 3 and 6. Contact pieces 51, 53 (FIG. 7) are formed on the opposed ends of the plates 44, 46, which may be silver or silver alloy-faced copper contacts, as is conventional.

The first and second switches are not identical but are arranged such that equal depression of the two actuators 40 and 50 causes the first switch for the live contact to close first, and the switch for the neutral contact second. This is achieved in a number of possible ways, for example making the separation between contact pieces 33 and 38 smaller than that between contact pieces 51 and 53 (by increasing their thickness or relative disposition), or increasing the length of the actuator 40 compared to actuator 50.

A generally L-shaped earth contact 52 extends into the recess 24, likewise having a springy bent over end portion to form a spring contact and a lower portion 54 constituting a spade terminal for connection of an electrical wire.

The annular recess 24, 26 and central opening 28 are all of a small radial dimension typically between 1.8 and 3.1 mm. Moreover, the contacts 30, 42 and 52 are disposed below the leading end of the body defined by the upper edges of the various walls by a safe distance which ensures that it is extremely difficult to inadvertently access the contacts. More particularly, the earth contact 52 is spaced from the uppermost edges of the adjacent walls by the smallest distance, the live contact 42 and neutral contacts being spaced a distance slightly greater distance below the upper edges of the adjacent walls. The seating of the actuators 40, 50 within the recess 22 and on opposite sides thereof means that it is near impossible to accidentally close a switch whilst the conductor is accessed.

Figure 4:
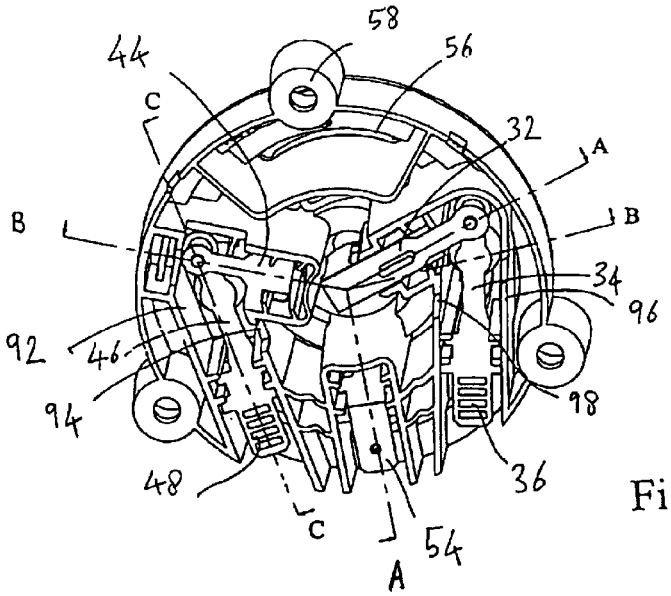
FIG. 4 is a view of the underside of the female connector part.
Figure 5:
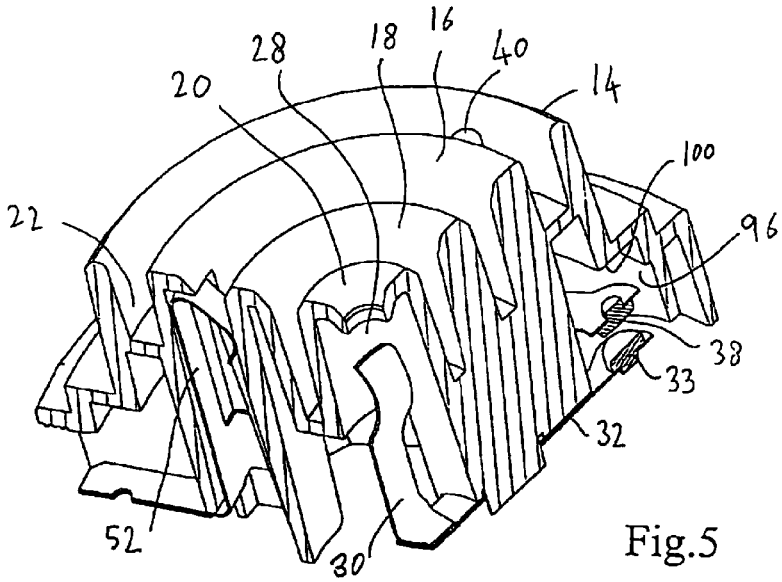
FIG. 5 is a sectional view along the line A—A in FIG. 4 (inverted relative to FIG. 4)

Also visible in the upturned view of FIG. 4 are water shedding openings 56 which allow water to drain from the recesses in the case that water is accidentally spilled onto the connector. Such openings are provided in each recess, including the outermost recess 22 for the actuators. Fixing points 58 are formed to allow the female connector part 12 to be secured onto the cordless appliance base 6.

A further important feature of the female connector part 12 is that those parts which are electrically live, that is to say permanently live whilst the base is connected to a mains supply, are isolated from any parts which can become wet in the case of accidental water spillage. More particularly, as best seen in FIGS. 4 and 7 the live springy contact strip 46 and its contact piece 53 are located in an open bottomed chamber which is defined by the underside of the body surface 90 and opposed walls 92, 94, and spaced a significant distance from the lowermost ends of the walls 92, 94. The contact piece 53 lies above the contact piece 51 of the fixed contact strip 44 and is in the disengaged position spaced therefrom. If water is spilled on the female connector 12 it can enter only at the recess and openings 24, 26, 28 and 30. The majority of the water will pass through the drain holes 56, but some 15 may run down the exposed contacts 42, 30, 52. Considering firstly only the contact 42 which makes the live connection any water passing down this will mostly fall vertically through the connector, but even if some water passes along the strip 44 to the contact piece 51 the spaced contact piece 53 and strip 46 and terminal 48 remain dry. In a similar manner the neutral contact strip 34 and piece 38 lie in a similar chamber defined by walls 96, 98 and underside surface 100 overlying the fixed contact 32 and contact piece 33 likewise remaining dry in the event of water spillage.

Figure 9:
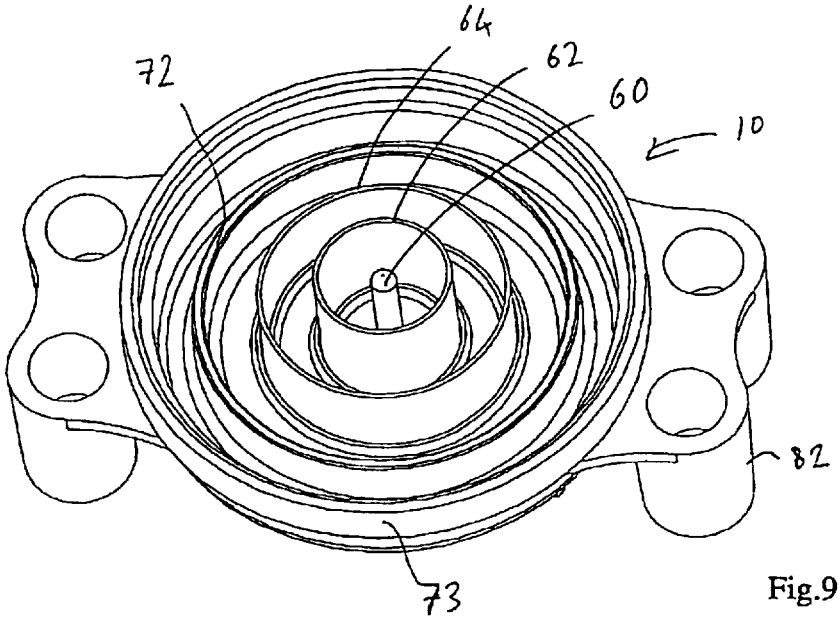
FIG. 9 is a view of the underside of the male connector part.
Figure 10:
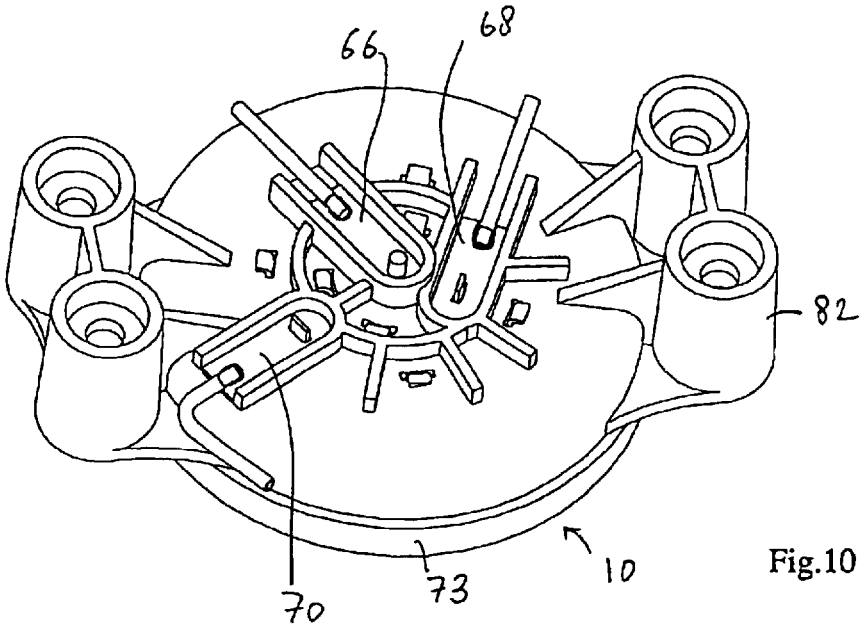
FIG. 10 is a top view of the male of the connector part.
Figure 11:
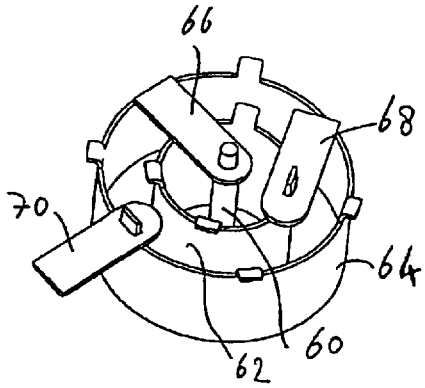
FIG. 11 is a disassembled view of conducting parts of the male connector part.

Turning now to the male connector part 10, the underside of the connector is shown in FIG. 9. The connector 10 comprises a moulded plastics body on which is fitted a central conducting pin 60 and concentric annular contacts 62 and 64. These make the neutral, live and earth connections respectively. As best seen in the part-disassembled view of FIG. 11, plate-like electrical conductors 66, 68 and 70 for the pin 60 and contacts 62 and 64 respectively are provided extending outwardly from the respective contacts, to which electrical wires are secured in a conventional manner. Moulded into the body of the connector outwardly of the outermost annular contact 64 is an additional annular surface 72 of reduced height as compared to the contacts 60, 62 and 64. An outer depending skirt 73 is provided which surrounds the outer wall 14 of the female connector part when engaged. When separated, the isolating switches ensure the live and neutral contacts are isolated from the electrical supply.

When the male and female connector parts 10 and 12 are mated, the contacts 60, 62 and 64 physically engage the contacts 30, 42 and 52 respectively. Owing to the relative dispositions of the contacts, the earth connection is made first, followed by the physical engagement of the live and neutral contacts. As the annular surface 72 enters the recess 22 it engages the actuators 40, 50 and depresses the switches to the closed position, the live electrical connection being made first followed by the neutral electrical connection so that power is supplied sequentially to the live and neutral contacts.

As will be appreciated, the male and female connector parts can be engaged in any relative rotational orientation throughout a full 360°. They can also be relatively rotated once mated together. The making of the physical connection between electrical contacts whilst still electrically isolated has the result that an effective physical contact can be assured prior to activation of the electrical contact, thereby reducing the risk of arcing. The sequential electrical connection of live and neutral connections further reduces the risk of arcing arising due to inductive and resistive effects of the electrical components such as the heating element and control element.

When the kettle is removed from the base and the connectors disengaged, the switches and contacts disengage in reverse order, the switch for the neutral contact disengaging first, followed by the switch for the live contact, followed by physical disengagement of the live and neutral annular contacts 60, 62 with the contacts 30, 42, and lastly the earth connection is broken. Again, the risk of arcing is considerably reduced.

As can be seen from the Figures, the connectors 10, 12 are of broad and relatively shallow construction. Tests have revealed that for kettles of a more squat design which typically would have an outer diameter of about 200 mm if the ratio of the engageable surface of the connector, that is the diameter across the female connector 12 measured between opposite sides of the outer wall 14, to the outer diameter of the kettle body at its base is greater than about 0.18 engagement of the connectors is particularly easy. In the case of more upright designs, which typically have an outer diameter of about 160 mm the ratio is of engageable surface of the connector to outside of the kettle must be greater than about 0.22. Having such a broad and yet shallow connector facilitates correct engagement of the kettle body on the base. This is in contrast to many prior designs where the connectors, are of a more vertical construction and generally smaller diameter where the user must very precisely align the appliance and the base before engaging.

Typically, the outer diameter of the female socket 12 is in the region of 3.9 cm. The distance of vertical travel is typically in the region of 1.2 cm.

Figure 13:
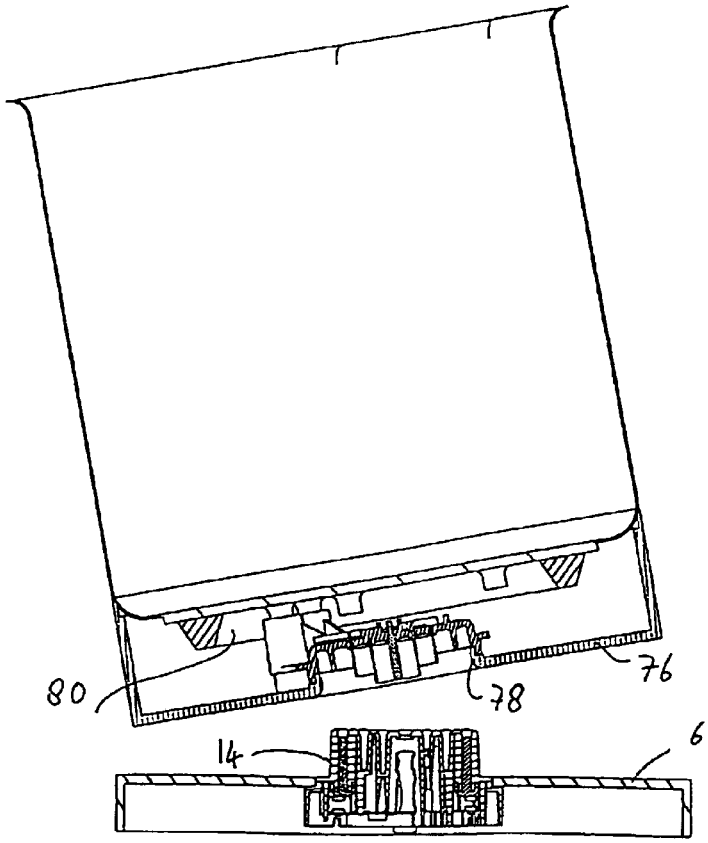
FIG. 13 is a sectional view along the line X—X of FIG. 12 of a lower part of the kettle as it is being fitted on the base.

FIG. 13 is a schematic cross-sectional view along the line X—X of FIG. 12 of the kettle 2 being fitted onto its cordless base 6. In existing cordless 360° type kettles with connectors mounted separate from heat sensitive switches the male connector is generally secured onto and supported by a cover part which encloses the base of the kettle and houses the heating element, dry boil switches and associated components. In contrast, the present embodiment supports the male connector 10 on part of the housing of the heating element itself, indicated 80. For this purpose the connector is provided with bosses 82 having openings through which screws (not shown) are fitted for attachment to the heating element housing 80. On assembly of the kettle the male connector 10 must be electrically connected to the heating element and the dry boil protectors and other associated components. This is troublesome since a relatively large number of wires and components need to be connected and in a manner where they cannot touch the heating element, and then must be enclosed beneath the cover. By permanently securing the wires for the live, neutral and earth contacts (as best seen in FIG. 9) for example by welding or soldering prior to securing of the connector it is possible to use shorter wires which can be easily connected to the heating element and switch(es) and easily constrained beneath the cover 76. More particularly, the assembly method involves permanently securing the electrical wires to the male connector, connecting the wires to the installed heating element and switches, followed by screwing the male connector to the heating element 80, followed by screwing the cover 76 to the male connector using screws which engage a second set of bosses provided on the male connector.

It will be seen that the edge of the male connector 10 is enclosed beneath the bottom cover 76 and extending through an opening in the cover. Around the outer edge of the opening the cover is formed with an edge region 78 which flares outwardly in which defines a curved surface which facilitates the initial positioning of the appliance, and assists by facilitating a rolling or pivoting action of the kettle once one edge is generally engaged with the side wall 14 as the kettle is being fitted on the base 6.

Thus, the connector as described above provides a structure which is very safe as well as providing advantages of ease of use.

What is claimed is:

1. An electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector part, said recesses and contacts being adapted to allow engagement of the connector parts over 360° of relative rotational orientation, wherein one connector part for the base is provided with an isolating switch or switches connected to the electrical contacts having a movable switch actuator or actuators engageable by engagement means on the other connector part, wherein the actuators and said engagement means are disposed relative to the electrical contacts on said connector parts such that physical contact is made between said electrical contacts before closing of the switch or switches on mating of the connector parts, wherein the one connector part for the base is provided with an annular recess within which the switch actuator or actuators extend, and wherein the other connector part is provided with an annular surface arranged to protrude into said annular recess and close said switches on mating of the male and female connector parts.

2. An electrical connector according to claim 1 wherein the switch actuator or actuators are provided at the lower end or ends with an upstanding skirt portion.

3. An electrical connector according to claim 1 wherein the actuators are disposed diametrically opposite to each other within their recess.

4. An electrical connector according to claim 1 wherein said annular recess has at least one opening therein for draining any fluid which is spilled in the recesses.

5. An electrical connector according to claim 1 wherein the annular surface provided on the male connector part has a leading edge which is spaced in the axial direction from leading edges of the first and second electrical annular contacts and the third central contact.

6. An electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector part, said recesses and contacts being adapted to allow engagement of the connector parts over 360° of relative rotational orientation, wherein one connector part being for the base is provided with isolating switches connected respectively to live and neutral electrical contacts having movable switch actuators engageable by engagement means on the other connector part, said isolating switches being adapted to close sequentially one before the other on mating of the connector parts.

7. An electrical connector for providing an electrical connection between the body of a cordless electrical appliance and a base which in use is connected to an electrical supply, the connector comprising a male connector part for connection to one of the appliance or base, and a female connector part for connection to the other of the appliance or base, the female connector part comprising recesses or openings provided with electrical contacts, and the male connector part comprising electrical contacts for engaging the contacts within the recesses or openings of the female connector, said recesses and contacts being adapted to allow engagement of the male and female connector parts over 360° of relative rotational orientation, wherein one female connector part for the base is provided with an isolating switch or switches connected to the electrical contacts having movable switch actuators extending into an annular recess on that connector part, and wherein other connector part is provided with an annular surface arranged to protrude into said annular recess to engage the actuators and close said switches on mating of the male and female connector, wherein the switch actuator or actuators are provided at the lower end or ends with an upstanding skirt portion.

8. An electrical connector according to claim 6 wherein the female connector part comprise a first outer annular recess and a second annular recess arranged within the first recess and concentric therewith, and a central third recess within the second recess, electrical contacts extending into each recess, the male connector part comprising a first outer annular contact, a second annular contact within the first annular contact and a third central contact within the second annular contact for engagement within the first, second, and third recesses of the female connector part respectively.

9. An electrical connector according to claim 6 wherein said two electrical contacts connected to the isolating switches are formed unitarily with or connected to springy strips disposed facing each other and spaced from fixed contact strips, and wherein said switch actuators are formed of non-conducting material disposed to engage the springy strips whereby displacement of the actuators urges the springy strips into contact with the fixed contact strips.

10. An electrical connector according to claim 6 wherein the one connector part for the base is provided with an annular recess within which the switch actuator or actuators extend, and wherein the other connector part is provided with an annular surface arranged to protrude into said annular recess and close said switches on mating of the male and female connector parts.

11. An electrical connector according to claim 6 wherein the electrical contacts in the recesses or openings of the female connector part are spring contacts against which the contacts of the male connector part engage on mating of the male and female connector parts.

12. A cordless electric kettle having a connector as defined in claim 6.

13. An electrical connector according to claim 6 wherein the actuators and said engagement means are disposed relative to the electrical contacts on said connector parts such that physical contact is made between said electrical contacts before closing of the switch or switches on mating of the connector parts.

14. A connector according to claim 8 wherein the switches are connected to the electrical contacts extending into the central recess, and into the second annular recess.

15. An electrical connector according to claim 8 wherein the electrical contacts extending into the first annular recess, second annular recess and third central recess are earth, live and neutral contacts respectively.

16. An electrical connector according to claim 9 wherein the distance between the fixed contact strip and the opposed springy strip is smaller in the case of one of the switches as compared to the other.

17. An electrical connector according to claim 10 wherein the switch actuator or actuators are provided at the lower end or ends with an upstanding skirt portion.

18. An electrical connector according to claim 10 wherein the actuators are disposed diametrically opposite to each other within their recess.

19. An electrical connector according to claim 18 wherein said annular recess has at least one opening therein for draining any fluid which is spilled in the recesses.

20. An electrical connector according to claim 18 wherein the annular surface provided on the male connector part has a leading edge which is spaced in the axial direction from leading edges of the first and second electrical annular contacts and the third central contact.

21. An electrical connector according to claim 7 wherein a pair of isolating switches are provided connected to respective contacts which in use are live and neutral contacts, said isolating switches being adapted to close and open sequentially one before the other on mating and disengagement of the connector parts.

22. An electrical connector according to claim 7 wherein the female connector part comprises a first outer annular recess and a second annular recess arranged within the first recess and concentric therewith, and a central third recess within the second recess, electrical contacts extending into each recess, the male connector part comprising a first outer annular contact, a second annular contact within the first annular contact and a third central contact within the second annular contact for engagement within the first, second and third recesses of the female connector part respectively.

23. An electrical connector according to claim 7 wherein the actuators are disposed diametrically opposite to each other within their recess.

24. An electrical connector according to claim 7 wherein the electrical contacts in the recesses or openings of the female connector part are spring contacts against which the contacts of the male connector part engage on mating of the male and female connector parts.

25. A cordless electric kettle having a connector as defined in claim 7.

26. An electrical connector according to claim 7 wherein the actuators and said engagement means are disposed relative to the electrical contacts on said connector parts such that physical contact is made between said electrical contacts before closing of the switch or switches on mating of the connector parts.

27. An electrical connector according to claim 21 wherein said two electrical contacts connected to the isolating switches are formed unitarily with or connected to springy strips disposed facing each other and spaced from fixed contact strips, and wherein said switch actuators are formed of non- conducting material disposed to engage the springy strips whereby displacement of the actuators urges the springy strips in to contact with the fixed contact strips.

28. A connector according to claim 22 wherein the switches are connected to the electrical contacts extending into the central recess, and into the second annular recess.

29. An electrical connector according to claim 22 wherein the electrical contacts extending into the first annular recess, second annular recess and third central recess are earth, live and neutral contacts respectively.

30. An electrical connector according to claim 27 wherein the distance between the fixed contact strip and the opposed springy strip is smaller in the case of one of the switches as compared to the other.

31. An electrical connector according claim to 23 wherein said annular recess has at least one opening therein for draining any fluid which is spilled in the recesses.

32. An electrical connector according to claim 23 wherein the annular surface provided on the male connector part has a leading edge which is spaced in the axial direction from leading edges of the first and second electrical annular contacts and the third central contact.

* * * * *